United States Patent [19]

Adams, III et al.

[11] 4,426,012

[45] Jan. 17, 1984

[54] RAILWAY CAR COUPLER

[75] Inventors: George E. Adams, III, East Aurora; Edwin C. Bailey, East Amherst; Richard F. Klimowicz, West Seneca; Geoffrey W. Cope, Williamsville, all of N.Y.

[73] Assignee: Dresser Industries, Inc., Dallas, Tex.

[21] Appl. No.: 323,529

[22] Filed: Nov. 23, 1981

[51] Int. Cl.[3] ..... B61G 3/06; B61G 3/08

[52] U.S. Cl. ..... 213/135; 213/149; 213/62 A; 213/217

[58] Field of Search ..... 213/62 R, 62 A, 135, 213/72, 109, 124, 125, 130, 131, 134, 137, 149, 211, 217, 159, 162, 138, 132

[56] References Cited

U.S. PATENT DOCUMENTS

| | | | |
|---|---|---|---|
| 560,864 | 5/1896 | Richards | 213/130 |
| 584,894 | 6/1897 | Richards | 213/130 |
| 801,438 | 10/1905 | Burnell | 213/130 |
| 841,805 | 1/1907 | McCarthy . | |
| 894,534 | 7/1908 | Richards | 213/130 |
| 904,153 | 11/1908 | Scheib, Sr. et al. | 213/124 |
| 1,495,463 | 5/1924 | Tomlinson | 213/130 |
| 2,072,606 | 3/1937 | Regan | 213/130 |
| 2,897,982 | 8/1959 | Larsson | 213/100 |
| 3,583,574 | 6/1971 | Herbert | 213/212 |
| 3,598,250 | 8/1971 | Terlecky | 213/162 |
| 4,267,935 | 5/1981 | Dilg | 213/72 |

FOREIGN PATENT DOCUMENTS

| | | | |
|---|---|---|---|
| 313992 | 1/1918 | Fed. Rep. of Germany | 213/130 |

*Primary Examiner*—Robert B. Reeves
*Assistant Examiner*—Richard Mathieu
*Attorney, Agent, or Firm*—B. E. Deutsch

[57] ABSTRACT

A railway car coupler includes a shank, a head connected to a head end portion of the shank, a knuckle pivoted to the head having closed and open positions, and a lock axially movable within a chamber formed in the shank between a knuckle engaged position for maintaining the knuckle in the closed position and a knuckle disengaged position for enabling the knuckle to be pivoted to the open position. A thrower is pivotally connected to the lock and has an arm disposed to one side of the pivot for engaging the knuckle to rotate the knuckle to its open position. An actuating mechanism is connected to the thrower-lock assembly and is axially movable within the chamber. The actuating mechanism functions to axially move the lock towards its knuckle disengaged position, with continued movement of the actuating mechanism in the same direction pivoting the thrower and consequentially the knuckle to its open position after the lock has obtained its knuckle disengaged position.

19 Claims, 14 Drawing Figures

RAILWAY CAR COUPLER

BACKGROUND OF THE INVENTION

This invention relates to railway car couplers and in particular to an actuating mechanism for moving the lock of the coupler to enable the coupler knuckle to be rotated between open and closed positions. Additionally, this invention further relates to a method of moving a lock between knuckle engaged and disengaged positions.

Almost all, if not all, standard AAR railway car couplers are required to have operating knuckles, that is knuckles that pivot between open and closed positions. Non-rotary couplers such as the standard AAR E and F type couplers and standard rotary couplers, include lock lift assemblies plus an actuating member for moving the coupler lock between knuckle engaged and disengaged positions. When the lock is engaged with the knuckle, the knuckle is maintained in its closed position. When the lock is moved relative to the knuckle, the knuckle can be pivoted to its open position. However, in rotary railway car couplers of the type wherein the lock is located in the coupler's shank and the knuckle is secured to and rotatable with a head about a shank a suitable actuating mechanism to operate the lock to enable the knuckle to be pivoted between its opened and closed positions has not heretofore been available. The actuating mechanism for the lock must be reliable yet not impede rotation of the knuckle and head. Further, the actuating mechanism-lock assembly should permit the lock to be placed in lockset position. Still further, since the lock is rotatable with the knuckle, the actuating mechanism must be flexible, as it too will rotate upon rotation of the head. Similarly, the actuating mechanism must not interfere with rotation of the shank when the shank is rotated and the head is maintained in a fixed position.

SUMMARY OF THE INVENTION

Accordingly, it is an object of this invention to improve actuating mechanism for the lock of a railway car coupler.

It is another object of this invention to improve rotary railway car couplers having an operating knuckle.

It is yet another object of this invention to actuate a lock located in the stationary part of a coupler's shank to enable the coupler's knuckle to be pivoted between opened and closed positions.

It is yet another object of this invention to provide suitable actuating means for the lock of a rotary railway car coupler such that the actuating means does not impede rotation of the rotatable components.

It is yet another object of this invention to interlock the knuckle with the shank of a railway car rotary coupler when the knuckle is in its fully opened position to prevent rotation of the knuckle and head.

It is still another object of this invention to provide an improved actuating mechanism for the lock which enables the lock to be readily placed in lockset position.

It is another object of this invention to generate forces acting on the lock to maintain the lock in lockset position or to force the lock into contact with the open knuckle to maintain the knuckle in the open position.

It is another object of this invention to axially move a lock of a railway car coupler to enable the knuckle to be rotated between open and closed positions.

These and other objects of the present invention are obtained in a railway coupler having a shank, a head connected to the head end portion of the shank, a knuckle pivoted to the head and having open and closed positions, and lock axially movable within a chamber formed in the shank between knuckle engaged position for maintaining the knuckle in its closed position and knuckle disengaged position for enabling the knuckle to be pivoted to its open position. A thrower is pivotally connected to the lock and has an arm disposed to one side of the pivot for engaging the knuckle to rotate the knuckle to its open position. An actuating mechanism is connected to the thrower-lock assembly and is axially movable within the chamber. The actuating mechanism functions to axially move the lock toward its knuckle disengaged position with continued movement of the actuating mechanism in the same direction pivoting the thrower and consequentially the knuckle to its open position after the lock has obtained its knuckle disengaged position.

DESCRIPTION OF THE PREFERRED EMBODIMENT

Although the present invention will be described as finding specific utility with a rotary type railway car coupler, it should be understood that the basic concept of the present invention is not limited to use with a rotary coupler but may be also utilized with standard railway car couplers such as standard AAR E and F type couplers.

Figure 1:
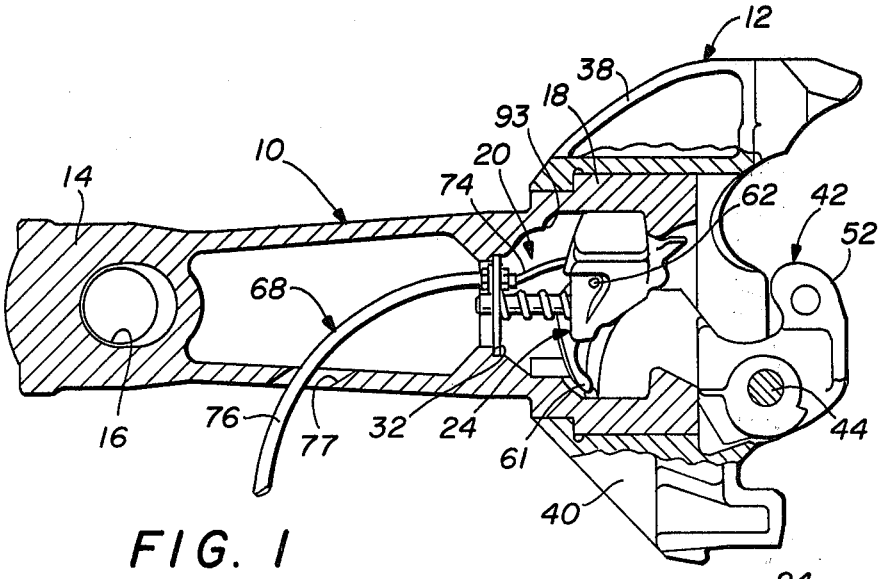
FIG. 1 is a sectional view, taken on a horizontal plane through the railway car coupler, illustrating details of the present invention.

The coupler of this invention is shown in FIG. 1 and includes a shank indicated generally at 10, rotatably connected to a coupler head assembly, indicated generally at 12 on head end portion 18 of the shank. The coupler head assembly is supported in rotatable relation on the head end portion of shank 10.

Coupler shank 10 has a coupler butt portion 14 on one end thereof and a yoke pin connecting aperture 16 formed vertically through butt end portion 14 of the shank. Head end portion 18 of shank 10 has exterior and interior surfaces shaped to cooperatively mount coupler head assembly 12. Details of the coupler head assembly and shank head end portion of shank 10 can be found in previously issued U.S. Pat. No. 4,267,935 which is specifically incorporated herein by reference.

Figure 2:
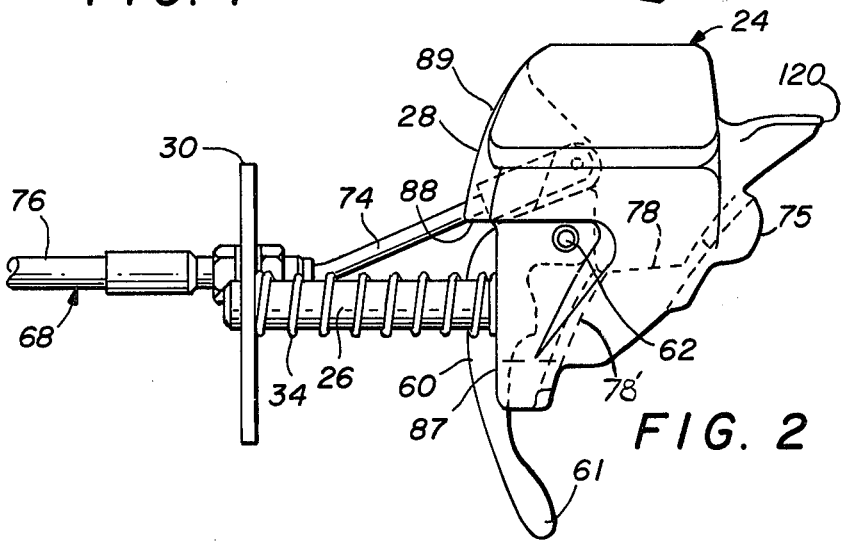
FIG. 2 is a top plan view of the lock and its associated actuating mechanism.
Figure 3:
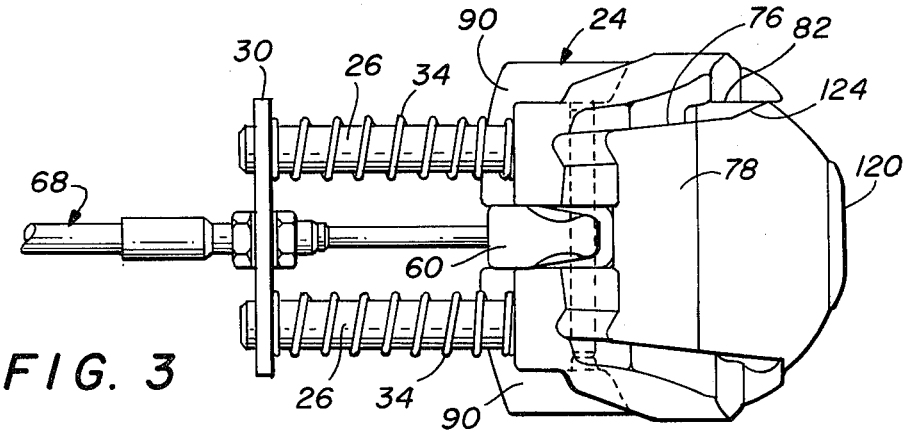
FIG. 3 is an elevation view of the lock and associated actuating mechanism.

Shank 10 includes an elongated chamber 20 extending axially from the head end portion toward the butt end portion. Lock 24 is disposed within chamber 20. As illustrated in FIGS. 2 and 3, lock 24 includes a pair of pins 26 extending inboard towards butt end portion 14 from rear face 28. The free ends of pins 26 project through apertures formed in plate 30, which, as illustrated in FIG. 1, is seated within chamber 20 against annular shoulder 32. Springs 34 are supported upon pins 26 between plate 30 and rear face 28 of the lock and provide a force urging the lock towards head end portion 18. Plate 30, and springs 34 are rotated by pins 26 upon rotation of lock 24.

Figure 8:
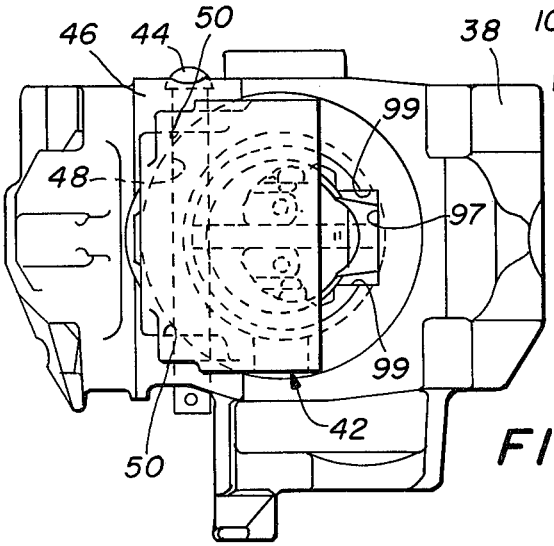
FIG. 8 is a knuckle end elevational view taken from the knuckle end of the railway car coupler.

Again referring to FIG. 1, coupler head assembly 12 is illustrated with the basic features of a standard AAR type F coupler head assembly, including guard arm portion 38 on one side thereof, a knuckle side portion 40 on the opposite side thereof and with a knuckle generally indicated at 42. Knuckle 42 is secured to knuckle side portion 40 of the coupler head assembly 12 by knuckle pivot pin 44. Pin 44 extends through pivot lugs 46 on the upper and lower portions of the coupler head and through a knuckle pivot pin opening 48 through the knuckle. Pivot lugs 46 each have a pin protector 50 extending generally inwardly toward the center portion of coupler head assembly 12 as shown in FIG. 8.

Figure 7:
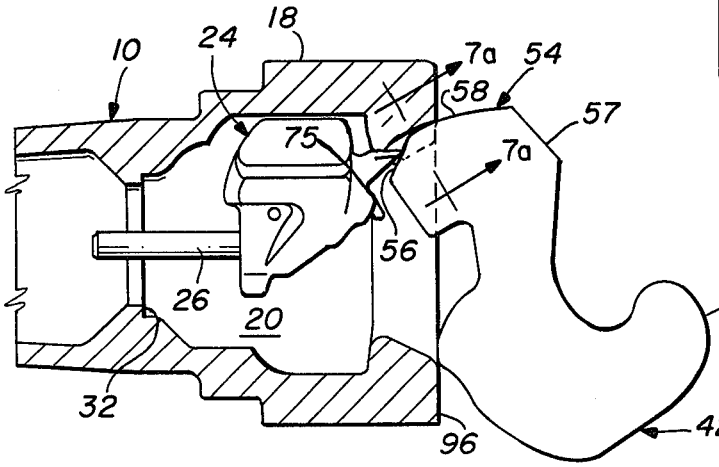
FIG. 7 is a top sectional view of the coupler head shank head end, lock and knuckle with the knuckle being in its open position.

Referring to FIGS. 1 and 7, knuckle 42 has a nose 52 of conventional style on the outboard portion thereof and a tail 54 on the inboard portion. Tail 54 includes a generally flat beveled face 56 terminating in a somewhat curved face 58.

With specific reference to FIGS. 2 and 3 further details of lock 24 shall now be described. Lock 24 includes knuckle thrower 60 pivotally attached thereto via pivot pin 62. Thrower 60 includes an arm 61 in contact with knuckle tail 54 when knuckle 42 is closed. Rotation of knuckle thrower 60 in a counterclockwise direction (as seen in FIGS. 1 and 2) about pivot 62 results in arm 61 rotating knuckle 42 from its closed position towards its open position. As shall be more fully described hereinafter, thrower 60 rotates in a counterclockwise direction as lock 24 is axially moved within chamber 20 towards butt end portion 14. An actuating mechanism 68 is connected to knuckle thrower 60 at the opposite side of pivot 62 from arm 61. The actuating mechanism includes a flexible cable 74 axially movable within chamber 20. A sheath 76 circumferentially surrounds the cable to guide and protect same and is secured in a fixed position as illustrated in FIGS. 2 and 3 to plate 30. Cable 74 and sheath 76 extend through an opening 77 formed in the side of shank 10.

Figure 10:
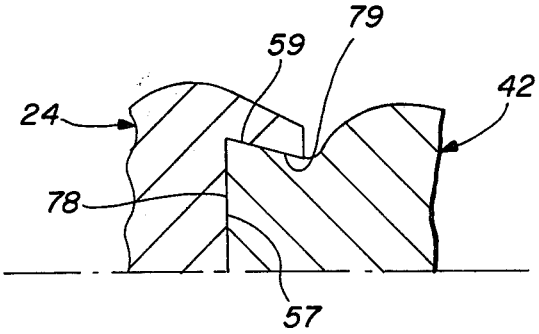
FIG. 10 is a sectional view taken along line 10—10 of FIG. 6.

As illustrated in FIGS. *6a* and *6b*, lock 24 includes a pair of vertical lugs 75 extending axially from the top and bottom of the front face 78' of the lock towards the head end portion of the shank. Each lug 75 includes a horizontally extending guide surface 76 for guiding locking face 57 of the knuckle into contact with locking face 78 of the lock when the knuckle is closed. Locking faces 57 and 78 are illustrated in FIGS. 2, 3, *6a* and 10 and comprise axially extending vertical surface. As shown specifically in FIG. 10, the upper and lower walls 59 extending radially from locking face 78 are slightly convergent. Conversely, upper and lower walls 79 extending laterally from locking face 57 are slightly divergent and dovetail within the space defined by walls 59. The interlocking fit between the lock and knuckle formed as a result of the dovetail relationship insures that the lock will rotate with head 12 and knuckle 42 when coupler 10 is a rotary coupler. When locking face 57 of the knuckle is engaged with locking face 78 of the lock, rotation of the knuckle to its open position is prevented. Top lug 75 includes a second horizontally disposed surface 82 spaced radially above guide surface 76 and separated therefrom by a vertically extending shoulder 84. This feature is particularly illustrated in FIG. *6a*. Second surface 82 is vertically spaced above the top surface of knuckle 42 when the lock is in the knuckle engaged position as is illustrated in FIG. *6b*. As shown in FIG. *6a*, axial movement of lock 24 towards the butt end portion of the shank results in relative movement between the lock and knuckle thereby bringing surface 82 into contact with the top surface of knuckle 42 and vertical shoulder 84 in interfering relationship with rear face 58 of knuckle 42. The position illustrated in FIG. *6a* is known as lockset condition and will be obtained only if knuckle 42 is prevented from rotating through interconnection with a locked knuckle from a second coupler.

As illustrated in FIGS. 2 and 3 rear face 85 of lock 24 includes a pair of vertically aligned shoulders 88 which define axially extending faces 90. Shoulders 88 separate rear face 28 into a generally flat portion 87 and a generally arcuate portion 89. The function of axially extending faces 90 shall be more fully explained hereinafter.

Figure 4:
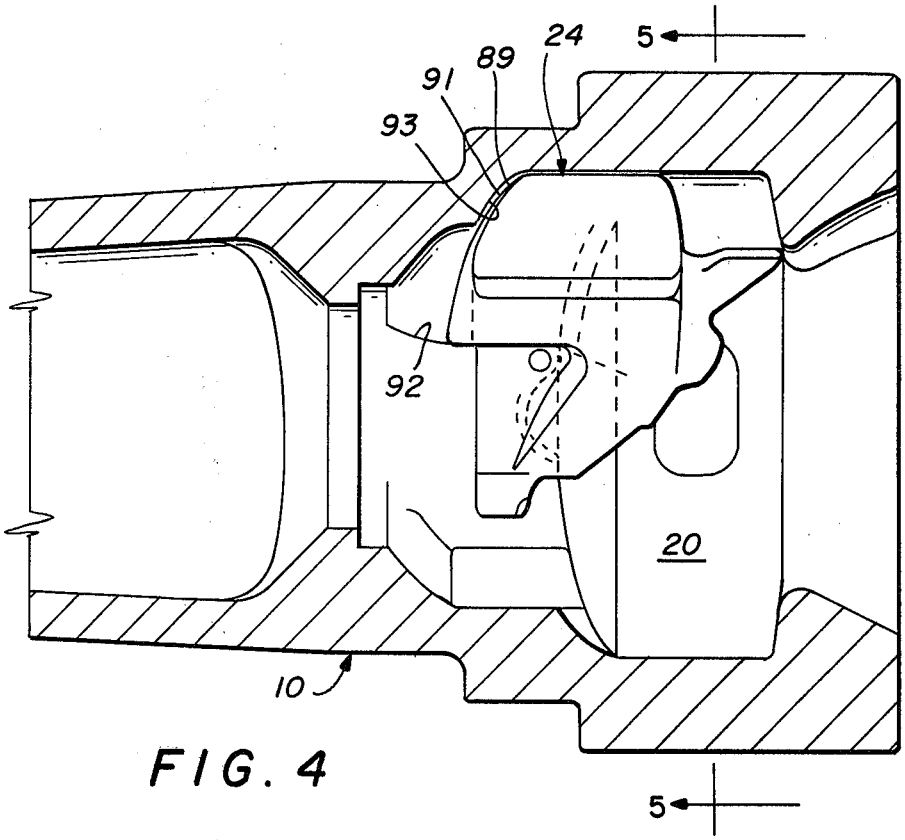
FIG. 4 is a top plan view of the coupler shank head end and lock, with the lock being disposed in the shank chamber in its open position.
Figure 5:
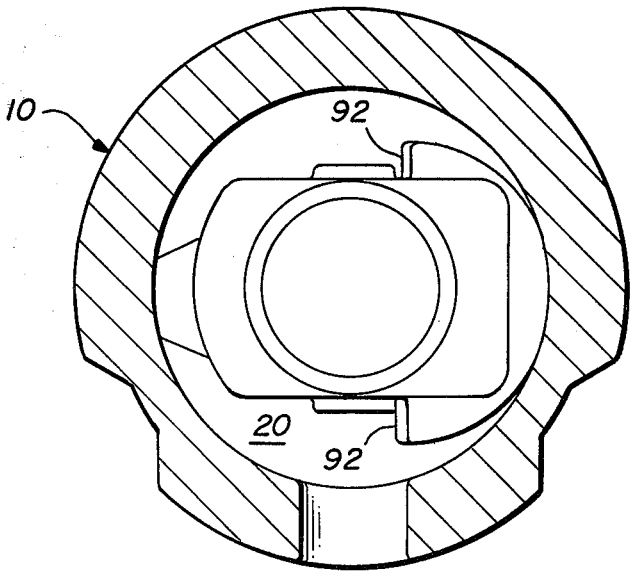
FIG. 5 is a knuckle end sectional view of the coupler shank taken along line 5—5 of FIG. 4, illustrating interior details within the shank's chamber, with the lock omitted for purposes of clarity.

Referring now to FIGS. 4 and 5, there is shown details of coupler shank 10 and in particular, details of chamber 20 thereof. As illustrated in FIG. 4, a somewhat arcuate wall 91 extends radially inward from the inside surface of shank 10 at one side thereof. The shape of wall 91 is identical to arcuate portion 89 of lock 24. When lock 24 is in its knuckle engaged position (as shown in FIG. 1) surface 93 of wall 91 is spaced from the rear face of the lock. When the lock is moved axially within chamber 20 into its knuckle disengaged position, the rear face of the lock contacts surface 93 of wall 91 to limit rearward movement of lock 24. Within the upper and lower portions of chamber 20 are spaced vertically aligned axially extending walls 92. As illustrated in FIG. 4, when lock 24 is moved into its knuckle disengaged position chamber walls 92 contact axially extending faces 90 of lock 24. The foregoing prevents the lock from rotating about its own longitudinal axis when moved into its knuckle disengaged position.

With reference to FIGS. 7, *7a* and 8 a further feature of the present invention will be described. FIGS. 7 and *7a* illustrate knuckle 42 in its open position. As illustrated front annular face 96 of shank 10 has slot 97 formed therein. As knuckle 42 is pivoted to its open position, a portion of knuckle tail 54 moves into slot 97. The complementary surfaces on the knuckle tail and slot 97 form an anti-rotational interlock between the respective parts. Essentially top and bottom walls 99 defining slot 97 form abutment surfaces for engaging complementary surfaces on tail 54. Since knuckle 42 is connected to head assembly 12, the anti-rotational interlock between the knuckle and shank prevents rotation of the knuckle and head relative to the shank when the knuckle is in its open position.

In operation, let us assume the knuckle is in its closed position, with the lock in engagement therewith as illustrated in FIG. 1. When actuating cable 74 is pulled axially towards butt end portion 14 of shank 10, lock 24 will be moved axially due to being its interconnected with thrower 60 and thus the actuating cable. Since the cable is connected to the thrower arm on the side of pivot 62 opposite from thrower arm 61, continued axial movement of the cable towards the butt end portion pivots the thrower in a counterclockwise direction to rotate the knuckle in a clockwise direction towards its open position. The foregoing movement of thrower 60 and knuckle 42 will occur once the lock has been moved axially relative to the knuckle such that locking face 78 of the lock is moved out of engagement with locking face 57 of the knuckle. This position of the knuckle and lock relative to each other immediately prior to rotation of thrower 60 is illustrated in FIG. 6*a*. Once the respective locking faces are in spaced relationship, knuckle 42 is free to rotate to its open position due to rotation of thrower 60. The lock will be moved axially towards the butt end portion until its arcuate rear face portion 89 engages surface 93 of shank wall 91 whereby further axial movement is prevented. As noted previously, at this point in time vertically aligned faces 90 extending axially from the rear face of the lock are engaged with vertical axially extending walls 92 formed in chamber 20 to prevent tilting of the lock about its own axis.

Figure 7A:
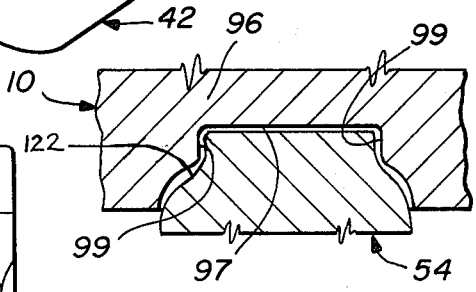
FIG. 7*a* is a sectional view taken along line 7*a*—7*a* in FIG. 7.

When the coupler is a rotary coupler, movement of the knuckle to its open position as illustrated in FIGS. 7 and 7*a* results in an anti-rotational lock being formed between the knuckle tail and slot 97 formed in annular front face 96 of the shank. The anti-rotational lock formed between the knuckle, and thus the coupler head attached thereto, with the shank prevents relative rotation between the knuckle and head and the shank.

Once the knuckle has been moved to its open position the force for maintaining actuating cable 74 and thus lock 24 in its knuckle disengaged position is no longer needed. The elimination of such force results in spring 34 forcing the lock forward to a position whereby the forwardly extending edge 120 of the lock engages face 56 of the knuckle tail (illustrated in FIG. 7) thereby maintaining the knuckle in its open position.

Figure 9:
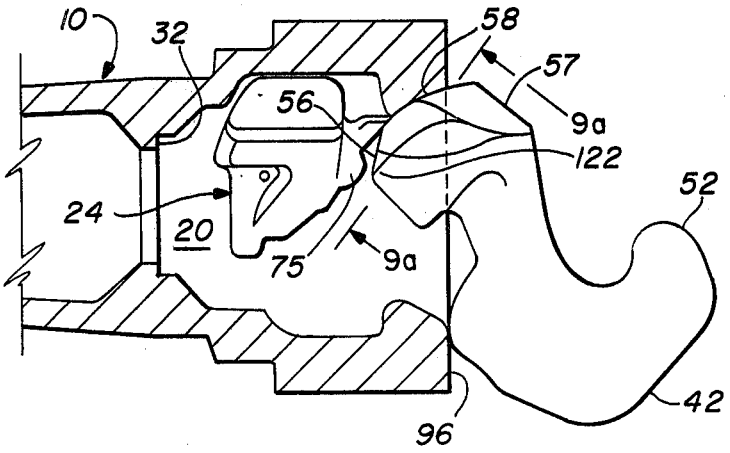
FIG. 9 is a plan view of the knuckle and lock illustrating the knuckle as it rotates from open towards closed position.
Figure 9A:
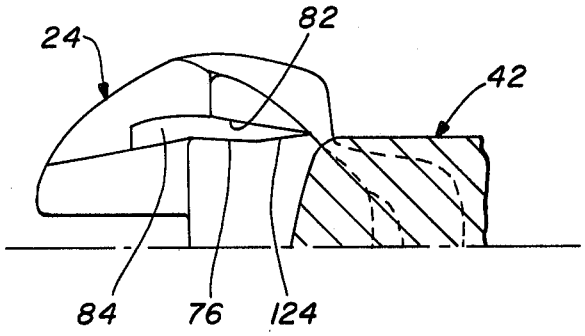
FIG. 9*a* is a sectional view taken along line 9*a*—9*a* of FIG. 9.

As illustrated in FIG. 7, the curved rear face of the knuckle tail defines a cam-like surface. The front edge 120 of the lock is in contact with beveled face 56 when the knuckle is in its open position. When the knuckle is initially rotated towards its closed position from its open position, the movement of the knuckle provides a force through engagement of front edge 120 with face 56 and then curved face 58 to force the lock axially within the chamber 20 towards the butt end portion of the shank. This enables the knuckle to be rotated counterclockwise to its fully closed position. Further to raise the lock within chamber 20 as is required to prevent the knuckle from being placed in lockset position, the top surface of knuckle 42 includes a surface 122 acting as a second cam-like surface. Surface 122 is illustrated in FIG. 9. This cam-like surface is rotated into engagement with inclined surface 124 of top lug 75 (the inclined surface being shown in FIGS. 3 and 9*a*) to move the lock upwardly within chamber 20 as the knuckle is rotated from its open position towards its closed position. As shown in FIG. 9*a*, the rear face of the knuckle tail is moved radially past shoulder 84 of the lock when the knuckle is fully open and thus out of contact with horizontal surface 82. This enables surface 122 and knuckle 42 to move along inclined surface 124 which serves as a ramp for cam-like surface 122, and thence engage horizontal surface 76 of upper lug 75 to raise the lock as the knuckle is closed. The force generated by springs 34 then returns the lock into locking engagement with knuckle 42 and the various components of the coupler reassume the position illustrated in FIG. 1.

An important feature of any railway car coupler involves the condition called lockset. When coupler lock 24 is placed in lockset position, knuckle 42 is ready to rotate to an unlocked or open position. This feature is important, as for example when a train of cars is being separated in a marshalling yard. When one of the coupler locks has been placed in lockset, the coupler will open when the cars are separated.

Figure 6:
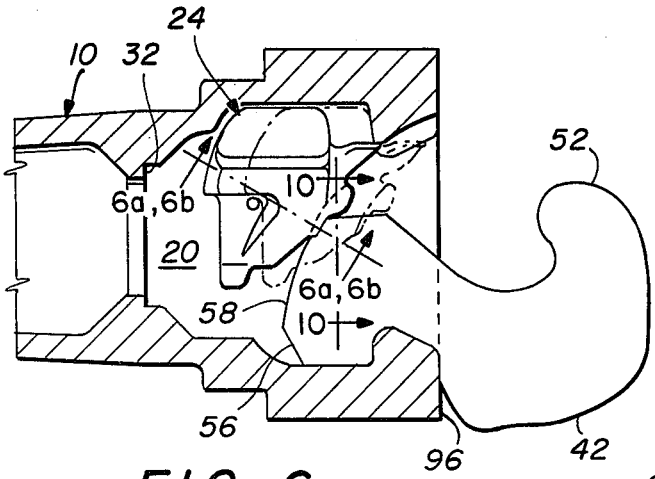
FIG. 6 is a top sectional view of the coupler illustrating the lock in lockset position in solid lines and in its locked position with respect to the knuckle in dotted lines.
Figure 6A:
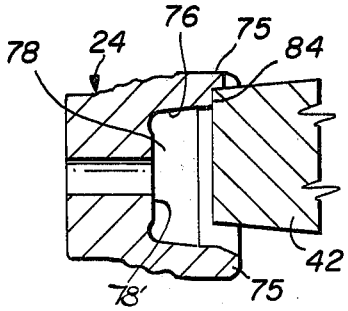
FIG. 6*a* is a sectional view taken along sectional line 6*a*—6*a* in FIG. 6 illustrating the lock in lockset position.
Figure 6B:
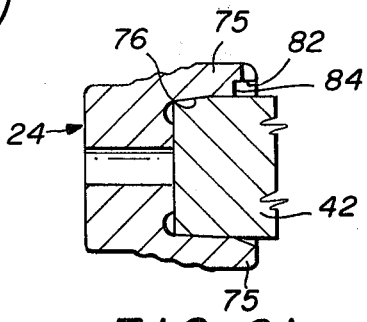
FIG. 6*b* is a view similar to FIG. 6*a* taken along line 6*b*—6*b* illustrating the lock in its locked position.

As illustrated in FIGS. 6 and 6*a*, the lock of the present design includes the lockset feature. FIG. 6*b* illustrates lock 24 in position relative to knuckle 42 when the knuckle is closed and the lock is engaged therewith. Guide surface 76 of lugs 75 span the upper and lower surface of knuckle 42. When actuating cable 74 moves the lock initially axially towards the butt end portion, surface 76 is moved out of contact with the upper surface of the knuckle. The weight of lock 24 causes the lock to fall within chamber 20 placing vertical shoulder 84 in interfering relationship with rear face 58 of knuckle 42. The lock no longer prevents the knuckle from rotating when in the position illustrated in 6*a* as locking surface 78 of the lock is axially spaced from the locking face 57 of the knuckle. After the lock has been placed in lockset position, the force moving cable 74 axially towards the butt end portion of the shank, is relaxed, enabling spring 34 to force the lock towards the knuckle. This maintains the lock in lockset position by restraining the lock from moving vertically upward within chamber 20 during subsequent movement of the railway car.

It should be emphasized that while many of the features described herein are particularly suitable for use with rotary railway car couplers other features may be employed with rotary or fixed railway car couplers. For example, the utilization of the axially movable actuating member finds utility with both rotary and non-rotary railway car coupler. Similarly, the lockset feature may also be used with both types of couplers. Further, the utilization of a spring force for maintaining a lock in engagement with a knuckle when in its open or closed position also may be utilized with both rotary and non-rotary couplers. However, some of the features are particularly suitable for use with rotary couplers. For example, since cable 74 is flexible, it does not interfere with rotation of head assembly including the lock and knuckle, or rotation of the shank relative to the head assembly. In fact, the flexibility feature of cable 74 accommodates the relative rotation between the shank and head assembly.

Cable 74 may be moved axially either automatically or manually by an operator. In any event, since the cable is flexible, it can be readily manipulated to obtain the desired axial movement of the lock.

While a preferred embodiment of this invention has been described and illustrated, the invention should not be limited thereto but may be otherwise embodied within the scope of the following claims.

The embodiments of the invention in which an exclusive property or privilege is claimed are defined as follows:

1. A railway car coupler comprising:

a shank having a butt end portion at one end and a head end portion at the opposite end and including an elongated chamber extending axially from said head end portion toward said butt end portion;

a head connected to said head end portion of said shank;

a knuckle pivotally connected to said head and having closed and open positions;

a lock disposed within the shank chamber and axially movable therewithin between a knuckle engaged position for maintaining said knuckle in a closed position and a knuckle disengaged position for enabling said knuckle to be pivoted to said open position;

thrower means pivotally connected to said lock and having an arm disposed to one side of said pivot for engaging said knuckle to rotate the knuckle to its open position; and axially movable actuating means disposed within said chamber and connected to said thrower means at the opposite side of said pivot from said arm with movement of said actuating means within the chamber toward said butt end of said shank initially moving said lock axially toward said knuckle disengaged position, with continued movement of said actuating means in the same axial direction pivoting said thrower means and consequentially said knuckle to its open position after the lock has obtained its knuckle disengaged position.

2. A railway car coupler in accordance with claim 1 wherein said head surrounds said head end portion and is rotatable relative to said shank.

3. A railway car coupler in accordance with claims 1 or 2 wherein said lock includes a vertical axially extending locking face and a pair of vertically spaced lugs extending axially from the top and bottom of said lock toward the head end portion of the shank for defining horizontal guide surfaces; and said knuckle includes a complementary locking face, said guide surfaces guiding the locking face of the knuckle into engagement with said lock locking face when the knuckle is closed.

4. A railway car coupler in accordance with claim 3 wherein the top lug includes a second horizontal surface spaced radially above the guide surface and separated therefrom by a vertically extending shoulder, said second surface being vertically spaced above the top surface of said knuckle when the lock is in its closed position, with movement of said lock toward its knuckle disengaged position resulting in the top horizontal guide surface being moved out of contact with the top surface of said knuckle, with the weight of the lock causing the lock to fall within the chamber whereby the second surface of said top guide lug spans the top surface of said knuckle, and said vertical shoulder is positioned in interfering relationship with the rear surface of said knuckle.

5. A railway car coupler in accordance with claim 2 wherein the head end portion of said shank includes an annular front wall having an opening for receiving a tail portion of said knuckle and includes an abutment surface engagable by a complementary surface on the tail of the knuckle when the knuckle is in its open position to interlock the knuckle and connected head with the shank to prevent rotation of the head relative to the shank when the knuckle is in its open position.

6. A railway car coupler in accordance with claim 3 wherein the head end portion of said shank includes an annular front wall having an opening for receiving a tail portion of said knuckle and includes at least one abutment surface engagable by a complementary surface on the tail of the knuckle when the knuckle is in its open position to interlock the knuckle and connected head with the shank to prevent rotation of the head relative to the shank when the knuckle is in its open position.

7. A railway car coupler in accordance with claim 1 wherein the rear face of the knuckle includes a cam-like surface; and the front face of the lock includes a surface engagable with the cam-like surface of the knuckle when the knuckle is in its open position whereby rotation of the knuckle towards its closed position provides a force through engagement of the respective surfaces to force the lock axially within the chamber towards the butt end portion of the shank.

8. A railway car coupler in accordance with claim 3 wherein the rear face of the knuckle includes a cam-like surface; and the front face of the lock includes a surface engagable with the cam-like surface of the knuckle when the knuckle is in its open position whereby rotation of the knuckle towards its closed position provides a force through engagement of the respective surfaces to force the lock axially within the chamber towards the butt end portion of the shank.

9. A railway car coupler in accordance with claim 3 further including spring means for providing a force for urging said lock to its knuckle engaged position.

10. A railway car coupler in accordance with claim 1 further including spring means for providing a force for urging said lock to its knuckle engaged position.

11. A railway car coupler in accordance with claim 1 wherein the rear face of the lock includes a vertical shoulder defining an axially extending face; and said shank chamber includes a vertical shoulder defining an axially extending face with the axial face of said lock engaging the axial face within said chamber as the lock is moved into its knuckle disengaged position.

12. A railway car coupler comprising:

a shank having a butt end portion at one end and head end portion at the opposite end and included an elongated chamber extending axially from said head end portion towards said butt end portion;

a head connected to said head end portion of said shank;

a knuckle pivotally connected to said head end portion and rotatable between opened and closed positions;

a lock disposed in said chamber and axially movable therewithin between knuckle engaged and disengaged positions;

thrower means pivotally connected to said lock and having an arm disposed to one side of said pivot for engaging said knuckle to rotate the knuckle to its open position when the lock is in its disengaged position;

said shank chamber including an abutment surface for limiting axial movement of the lock in the knuckle disengaged position; and a flexible cable connected to said thrower means at the opposite side of said pivot from said arm and axially movable within said chamber toward said butt end of said shank, with axial movement of said cable toward said butt end initially moving said lock axially toward said knuckle disengaged position with continued movement of said cable in the same axial direction pivoting said thrower means and consequentially said knuckle to its open position after the lock has obtained its knuckle disengaged position.

13. A railway car coupler in accordance with claim 12 wherein said lock includes a rear face extending towards said butt end portion of said shank, said rear face including at least one pin extending axially towards said butt end portion; a plate having an aperture for slidably receiving the free end of said pin; and a spring secured about the pin between said plate and said rear face of said lock for providing a force urging said lock toward the head end portion of said chamber.

14. A railway car coupler in accordance with claim 13 wherein said flexible cable includes a sheath circumferentially disposed thereabout, said sheath being affixed to said plate for maintaining the sheath in a fixed position relative to the axially movable flexible cable.

15. A railway car coupler in accordance with claims 13 or 14 wherein said shank chamber includes an annular shoulder providing a seat for said plate to maintain said plate in an axially fixed position within said chamber.

16. A railway car coupler in accordance with claims 12 or 13 wherein said head surrounds said head end portion of said shank and is rotatable relative thereto.

17. A railway car coupler comprising:

a shank having a butt end portion at one end and a head end portion at the opposite end and including an elongated chamber extending axially from said head end portion towards said butt end portion;

a head connected to said head end portion of said shank;

a knuckle pivotally connected to said head end portion and rotatable between open and closed positions and having a nose section and a tail section, said tail section including a cam like surface formed on the upper face thereof;

a lock disposed in said chamber and axially movable therewithin between knuckle engaged and disengaged positions, including a lug extending axially from the top surface thereof toward said knuckle tail and including a vertical shoulder separating upper and lower horizontal surfaces, and an inclined ramp-like surface connecting said upper and lower horizontal surfaces;

thrower means pivotally connected to the lock and having an arm disposed to one side of said pivot for engaging said knuckle to rotate the knuckle to its open position when the lock is in its disengaged position;

axially movable actuating means disposed within said chamber and connected to said thrower means at the opposite side of said pivot from said arm, with movement of said actuating means within the chamber towards said butt end of said shank initially moving said lock axially towards said knuckle disengaged position, with continued movement of said actuating means in the same axial direction pivoting said thrower means and consequentially said knuckle to its open position after the lock has obtained its knuckle disengaged position; and the lower horizontal surface of said lock lug engaging the upper surface of the knuckle tail when the lock is in its knuckle engaged position, said lock moving downwardly within said chamber as it is moved axially towards its knuckle disengaged position, said ramp like surface guiding the raised cam like surface of said knuckle tail into engagement with said lug lower horizontal surface for raising the lock as the knuckle is moved from its open towards its closed position.

18. A railway car coupler in accordance with claim 17 wherein said head surrounds said head end portion and is rotatable relative thereto.

19. A railway car coupler in accordance with claim 18 wherein said lock includes a vertical axially extending locking face and said knuckle includes a complementary locking face with one of said locking faces including upper and lower vertically spaced diverging walls and the other of said locking faces including upper and lower vertically spaced converging walls, the diverging walls fitting within the converging walls to form a dove-tailed interlocking fit to insure that said lock rotates with said knuckle and said head relative to said shank.

* * * * *